US009548190B2

(12) United States Patent
Campbell et al.

(10) Patent No.: US 9,548,190 B2
(45) Date of Patent: Jan. 17, 2017

(54) SCHEDULED MS$^3$ FOR QUANTITATION

(71) Applicant: DH TECHNOLOGIES DEVELOPMENT PTE. LTD., Singapore (SG)

(72) Inventors: John Lawrence Campbell, Milton (CA); David Michael Cox, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/443,930

(22) PCT Filed: Nov. 21, 2013

(86) PCT No.: PCT/IB2013/002605
§ 371 (c)(1),
(2) Date: May 19, 2015

(87) PCT Pub. No.: WO2014/096914
PCT Pub. Date: Jun. 26, 2014

(65) Prior Publication Data

US 2015/0318154 A1 Nov. 5, 2015

Related U.S. Application Data

(60) Provisional application No. 61/739,841, filed on Dec. 20, 2012.

(51) Int. Cl.
*H01J 49/00* (2006.01)
*H01J 49/02* (2006.01)

(52) U.S. Cl.
CPC ..... *H01J 49/0081* (2013.01); *H01J 49/004* (2013.01); *H01J 49/0036* (2013.01); *H01J 49/022* (2013.01)

(58) Field of Classification Search
CPC .. H01J 49/0036; H01J 49/004; H01J 49/0081; H01J 49/022
See application file for complete search history.

(56) References Cited

U.S. PATENT DOCUMENTS 8,278,619 B2 * 10/2012 Makarov ..... H01J 49/04 250/281
2005/0098719 A1 * 5/2005 Thomson ..... H01J 49/0081 250/288

(Continued)

FOREIGN PATENT DOCUMENTS

WO 2008-146100 A1 12/2008
WO 2009-138179 A2 11/2009

OTHER PUBLICATIONS

Zumwalt, M., et al, "A Comparison of Several LC/MS Techniques for Use in Toxicology" www.agilent.com/chem, Apr. 12, 2010.*

(Continued)

*Primary Examiner* — Wyatt Stoffa
(74) *Attorney, Agent, or Firm* — John R. Kasha; Kelly L. Kasha; Kasha Law LLC

(57) ABSTRACT

Systems and methods are provided for scheduled MS$^3$. A compound of interest is separated from a sample over a known time period using a separation device. A plurality of sMRM experiments are performed over the known time period on the separating compound of interest using a mass spectrometer. An intensity of a product ion of the compound of interest is produced for each of the plurality of sMRM experiments. Each intensity for the product ion for each of the plurality of sMRM experiments is compared to a threshold intensity level using a processor. When an intensity for the product ion of an sMRM experiment of the plurality of sMRM experiments is equal to or exceeds the threshold intensity level, the mass spectrometer is instructed to per- (Continued)

form one or more $MS^3$ experiments for the product ion using the processor.

17 Claims, 5 Drawing Sheets

(56) References Cited

U.S. PATENT DOCUMENTS

2005/0277789 A1 12/2005 Bloomfield et al.
2007/0138384 A1* 6/2007 Keiser ..... H01J 49/0031 250/282
2009/0236513 A1* 9/2009 Lock ..... H01J 49/004 250/282
2011/0091981 A1 4/2011 Williamson et al.
2011/0297823 A1* 12/2011 Coon ..... H01J 49/004 250/282
2011/0315870 A1* 12/2011 Lock ..... H01J 49/004 250/282
2012/0032074 A1 2/2012 Kenny
2012/0191369 A1* 7/2012 Yamaguchi ..... H01J 49/0036 702/23
2012/0261568 A1* 10/2012 Coon ..... G06F 19/18 250/282
2013/0181124 A1* 7/2013 Nishida ..... H01J 49/0031 250/282
2013/0297230 A1* 11/2013 Kawase ..... G06F 19/703 702/32
2013/0299693 A1* 11/2013 Xia ..... H01J 49/0063 250/283
2013/0334414 A1* 12/2013 McAlister ..... G01N 33/50 250/283
2014/0094594 A1* 4/2014 Rush ..... B01D 15/3809 530/387.9
2014/0138537 A1* 5/2014 Grothe, Jr. ..... H01J 49/26 250/282
2014/0299762 A1* 10/2014 Mukaibatake ..... H01J 49/0036 250/283
2015/0108344 A1* 4/2015 Anderson ..... G01N 33/6848 250/282
2015/0170893 A1* 6/2015 Shion ..... H01J 49/0045 250/283

OTHER PUBLICATIONS

International Search Report and Written Opinion for PCT/IB2013/002605, mailed Apr. 22, 2014.

* cited by examiner

100

300

400

SCHEDULED $MS^3$ FOR QUANTITATION

CROSS REFERENCE TO RELATED APPLICATION

This application claims the benefit of U.S. Provisional Patent Application Ser. No. 61/739,841, filed Dec. 20, 2012, the content of which is incorporated by reference herein in its entirety.

INTRODUCTION

Mass spectrometry/mass spectrometry/mass spectrometry ($MS^3$) is an increasing popular technique for quantitation experiments. Like multiple reaction monitoring (MRM), or selected reaction monitoring (SRM), which is commonly used in quantitation, $MS^3$ involves selecting a precursor ion for fragmentation and monitoring the fragmentation for a fragment ion, or product ion. However, $MS^3$ includes the additional step of fragmenting the product ion and monitoring that fragmentation for a secondary fragment ion. This additional step gives $MS^3$ experiments greater specificity and greater resilience to chemical noise in comparison to MRM experiments.

However, $MS^3$ experiments, in general, have cycle times that are much longer than traditional MRM experiments. In addition, $MS^3$ experiments require more complicated experiment development than MRM experiments. As a result, $MS^3$ experiments are difficult to perform dynamically or in an untargeted fashion when used as part of a quantitation experiment.

SUMMARY

A system is disclosed for scheduled $MS^3$. The system includes a separation device, a mass spectrometer, and a processor. The separation device separates a compound of interest from a sample over a known time period. The mass spectrometer performs a plurality of scheduled MRM (sMRM) experiments over the known time period on the separating compound of interest. The mass spectrometer produces an intensity of a product ion of the compound of interest for each of the plurality of sMRM experiments.

The processor receives each intensity for the product ion for each of the plurality of sMRM experiments from the mass spectrometer. The processor compares each intensity for the product ion for each of the plurality of sMRM experiments to a threshold intensity level. When an intensity for the product ion of an sMRM experiment of the plurality of sMRM experiments is equal to or exceeds the threshold intensity level, the processor instructs the mass spectrometer to perform one or more $MS^3$ experiments for the product ion. As a result, processor produces intensities of one or more secondary fragment ions of the compound of interest for each of the one or more $MS^3$ experiments.

A method is disclosed for scheduled $MS^3$. A compound of interest is separated from a sample over a known time period using a separation device. A plurality of sMRM experiments are performed over the known time period on the separating compound of interest using a mass spectrometer. An intensity of a product ion of the compound of interest is produced for each of the plurality of sMRM experiments.

Each intensity for the product ion for each of the plurality of sMRM experiments is received from the mass spectrometer using a processor. Each intensity for the product ion for each of the plurality of sMRM experiments is compared to a threshold intensity level using the processor. When an intensity for the product ion of an sMRM experiment of the plurality of sMRM experiments is equal to or exceeds the threshold intensity level, the mass spectrometer is instructed to perform one or more $MS^3$ experiments for the product ion using the processor. Intensities of one or more secondary fragment ions of the compound of interest are produced for each of the one or more $MS^3$ experiments. The resulting analytical signal, which relates the detected $MS^3$ experiment signals and the retention time of detection, can be used to quantify the amount of the target analyte present during the analysis.

A computer program product is disclosed that includes a non-transitory and tangible computer-readable storage medium whose contents include a program with instructions being executed on a processor so as to perform a method for scheduled $MS^3$. In various embodiments, the method includes providing a system, wherein the system comprises one or more distinct software modules, and wherein the distinct software modules comprise an analysis module and a control module.

The analysis module receives an intensity for a product ion for each of a plurality of sMRM experiments from a mass spectrometer. Each intensity for the product ion of each of the plurality of sMRM experiments is produced by performing the plurality of sMRM experiments over a known time period on a separating compound of interest using a mass spectrometer. The separating compound of interest is separated from a sample over the known time period using a separation device.

The analysis module compares each intensity for the product ion for each of the plurality of sMRM experiments to a threshold intensity level. When an intensity for the product ion of an sMRM experiment of the plurality of sMRM experiments is equal to or exceeds the threshold intensity level, the control module instructs the mass spectrometer to perform one or more $MS^3$ experiments for the product ion using the processor. Intensities of one or more of the secondary fragment ions of the compound of interest are produced for each of the one or more $MS^3$ experiments. The resulting analytical signal, which relates the detected $MS^3$ experiment signals and the retention time of detection, can be used to quantify the amount of the target analyte present during the analysis.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
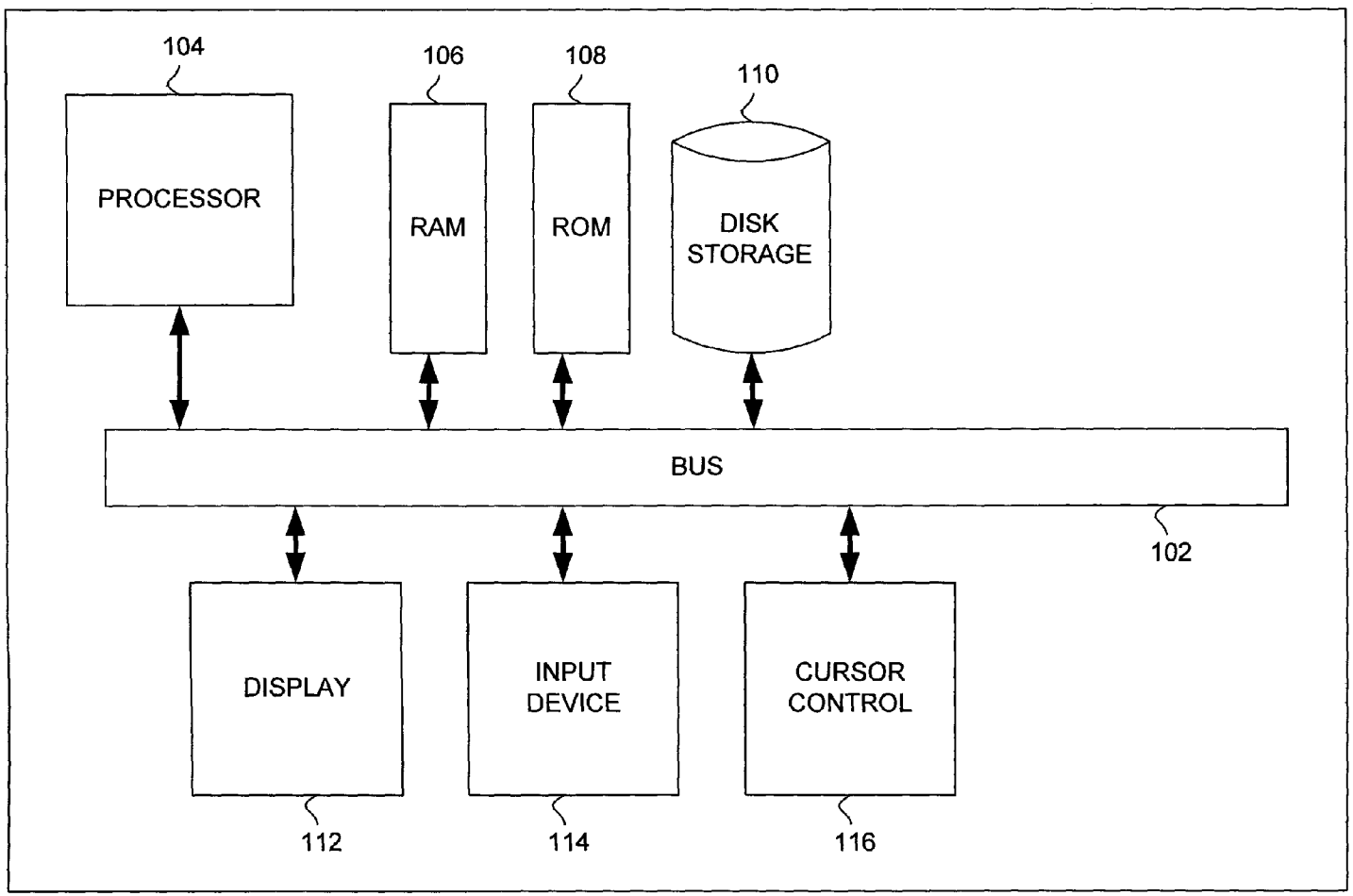
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Scheduled $MS^3$

As described above, mass spectrometry/mass spectrometry/mass spectrometry ($MS^3$) experiments provide greater specificity and greater resilience to chemical noise as compared to multiple reaction monitoring (MRM) experiments. However, $MS^3$ experiments, in general, have cycle times that are much longer than traditional MRM experiments and require more complicated experiment development than MRM experiments. As a result, $MS^3$ experiments are difficult to perform dynamically or in an untargeted fashion when used as part of a quantitation experiment.

In various embodiments, scheduled MRM (sMRM) experiments are used to trigger one or more $MS^3$ experiments dynamically and combine the advantages of both techniques. For example, one or more sMRM experiments are scheduled during the predicted or known elution time of a given analyte. If the ion current intensity of a fragment ion of one of the sMRM experiments reaches or exceeds a threshold level, a cycle of $MS^3$ experiments are initiated on the sMRM transition of that fragment ion. While sMRM experiments are illustrated as a preferred embodiment, one skilled in the art will appreciate that this is a non-limiting example and that other types of MRM experiments, including unscheduled MRM experiments, can equally be used.

Figure 2:
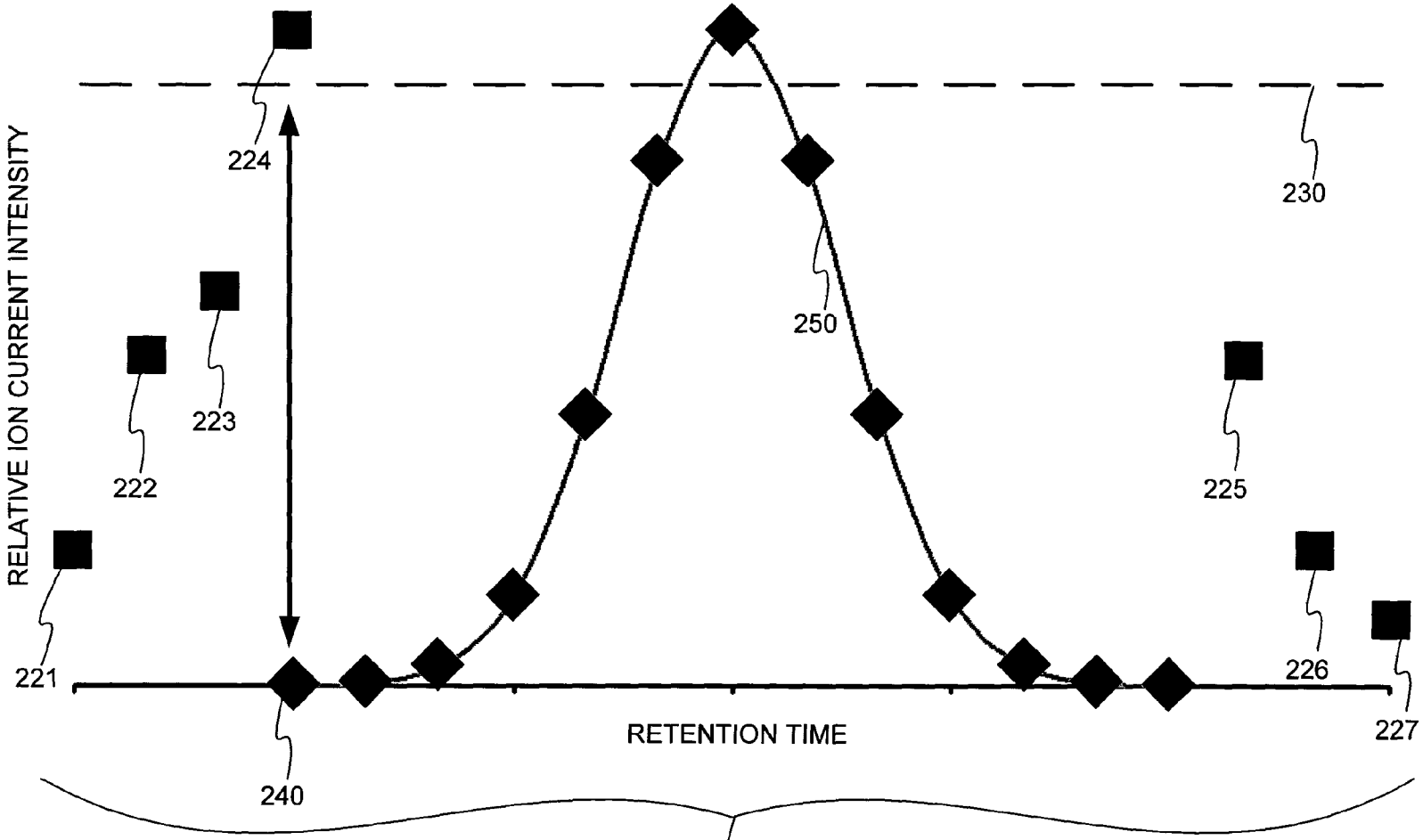
FIG. 2 is an exemplary plot of sMRM signal levels and a cycle of $MS^3$ acquisitions triggered by an sMRM signal that reaches a threshold level within a retention time (RT) window, in accordance with various embodiments.

FIG. 2 is an exemplary plot 200 of sMRM signal levels and a cycle of $MS^3$ acquisitions triggered by an sMRM signal that reaches a threshold level within a retention time (RT) window, in accordance with various embodiments. In plot 200, RT window 210 represents all or part of the predicted or known elution time of an analyte, or compound of interest. The compound of interest is eluted using a separation technique, such as liquid chromatography for example.

sMRM events are scheduled for RT window 210. During these sMRM events, the compound of interest, or precursor ion, is fragmented and the fragmentation is monitored for a particular product ion. sMRM signal levels 221 through 227 represent the relative ion current intensity recorded for the product ion for seven exemplary sMRM events, for example. One skilled in the art can appreciate that hundreds of MRM experiments can be scheduled within a retention time window. As a result, the seven sMRM signal levels 221 through 227 are merely representative of a larger number of MRM experiments.

sMRM signal levels 221 through 223 show that the signal strength of the product ion increases with time within the RT window. Because an $MS^3$ experiment involves the additional isolation of the product ion and fragmentation into a particular secondary fragment ion, a certain signal level, or threshold signal level, is required for the product ion from the MRM experiment. The threshold signal level of the product ion ensures that the signal-to-noise and signal count of the secondary fragment ion is worthwhile for detection in the $MS^3$ experiment. The threshold signal level is provided by a user or selected by the instrument, for example.

In plot 200 of FIG. 2, sMRM signal level 224 is the first signal level to reach or exceed threshold signal level 230 that was established for $MS^3$ experiments. When a processor determines sMRM signal level 224 is the first signal level to reach or exceed threshold signal level 230, it automatically triggers or instructs the mass spectrometer to start a cycle of $MS^3$ experiments. These $MS^3$ experiments produce a series of ion current intensities for the secondary fragment ion. $MS^3$ signal level 240 is representative of an ion current intensity recorded for one of the triggered cycle of $MS^3$ experiments.

One skilled in the art can appreciate that the 13 plotted ion current intensities for the triggered cycle of $MS^3$ experiments shown in plot 200 of FIG. 2 are merely representative of a larger number $MS^3$ experiments and ion current intensities recorded in a typical quantitation experiment. In general, a sufficient number of $MS^3$ experiments are performed in order to record enough ion current intensities for the secondary fragment ion to provide a reliable peak shape, or to provide a reliable survey of points across an LC peak, for example. In plot 200, curve 250 is fit to the 13 plotted ion current intensities for the triggered cycle of $MS^3$ experiments to provide a representation of a peak shape, for example.

sMRM signal levels 225 through 227 show that the signal strength of the product ion from MRM experiments eventually decreases again with time within the RT window. Although additional sMRM signal levels are not shown in plot 200 of FIG. 2 between sMRM signal levels 224 through 225, sMRM experiments can continue during this period and the data from these experiments can be recorded and used. Alternatively, sMRM experiments can be halted during this period.

One skilled in the art can appreciate that although data for the sMRM experiments and the data for the triggered $MS^3$ experiments are shown together in plot 200 of FIG. 2, these data are plotted using different scales. In other words, sMRM experiments can occur at a much higher rate than $MS^3$ experiments. Also, the peak intensities recorded for the sMRM experiments can be different from the peak intensities recorded for the $MS^3$ experiments.

System for Scheduled $MS^3$

Figure 3:
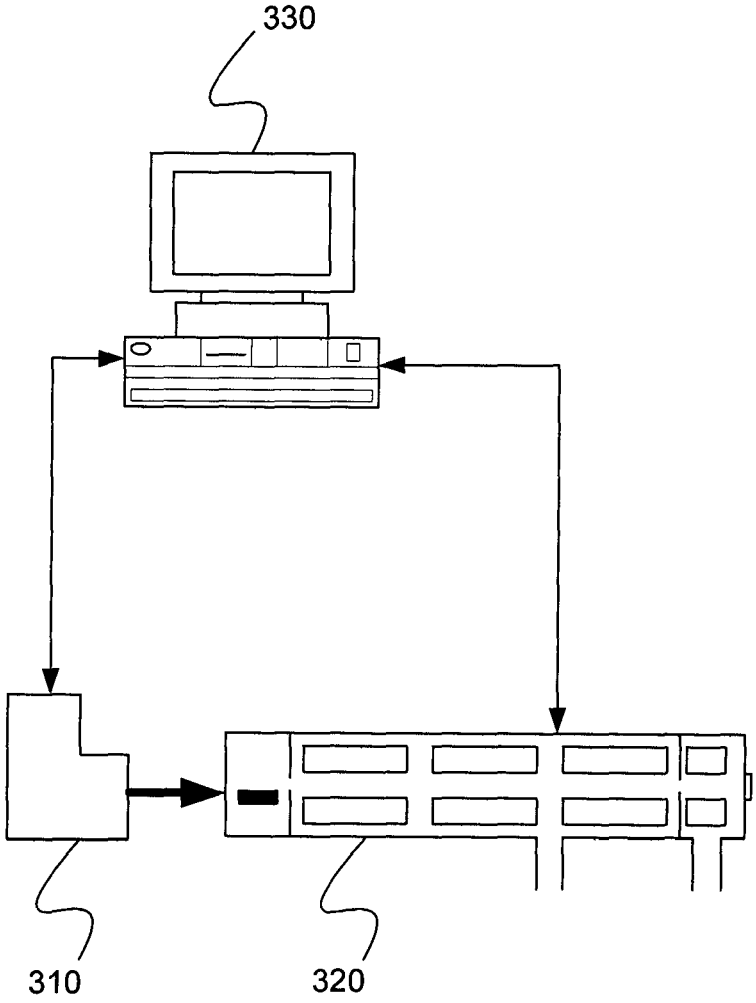
FIG. 3 is a schematic diagram showing a system for scheduled $MS^3$, in accordance with various embodiments.

FIG. 3 is a schematic diagram showing a system 300 for scheduled $MS^3$, in accordance with various embodiments. System 300 includes separation device 310, mass spectrometer 320, and processor 330. Separation device 310 can perform a separation technique that includes, but is not limited to, liquid chromatography, gas chromatography, capillary electrophoresis, or ion mobility.

Mass spectrometer 320 can include one or more physical mass analyzers that perform one or more mass analyses. A mass analyzer of a mass spectrometer can include, but is not limited to, a time-of-flight (TOF), quadrupole, an ion trap, a linear ion trap, an orbitrap, or a Fourier transform mass analyzer.

Processor 330 can be, but is not limited to, a computer, microprocessor, or any device capable of sending and receiving control signals and data to and from mass spectrometer 320 and processing data. Processor 330 is in communication with separation device 310 and mass spectrometer 320.

Separation device 310 separates a compound of interest from a sample over a known time period. Mass spectrometer 320 performs a plurality of scheduled multiple reaction monitoring (sMRM) experiments over the known time period on the separating compound of interest. Mass spectrometer 320 produces an intensity of a product ion of the compound of interest for each of the plurality of sMRM experiments. In various embodiments, separation device 310 separates the compound of interest and mass spectrometer 320 performs the plurality of sMRM experiments under the control of processor 330.

Processor 330 receives each intensity for the product ion for each of the plurality of sMRM experiments from mass spectrometer 320. Processor 330 compares each intensity for the product ion for each of the plurality of sMRM experiments to a threshold intensity level. When an intensity for the product ion of an sMRM experiment of the plurality of sMRM experiments is equal to or exceeds the threshold intensity level, processor 330 instructs mass spectrometer 320 to perform one or more $MS^3$ experiments for the product ion. As a result, processor 330 produces intensities of one or more secondary fragment ions of the compound of interest for each of the one or more $MS^3$ experiments.

In addition to quantitation, scheduled $MS^3$ can be used for qualitative analysis. In various embodiments, processor 330 further identifies the compound of interest from an intensity of the secondary fragment ion produced by the one or more $MS^3$ experiments. Processor 330 identifies the compound by comparing the intensity of the secondary fragment ion to a library or database of secondary fragment ions for known compounds, for example.

For quantitation a cycle or series of $MS^3$ experiments is triggered, when an intensity for the product ion of an sMRM experiment of the plurality of sMRM experiments is equal to or exceeds the threshold intensity level. In various embodiments, processor 330 instructs mass spectrometer 320 to perform a cycle or series of $MS^3$ experiments that provide a number of intensities of the secondary fragment ion over time sufficient to quantify the compound of interest in the sample.

In various embodiments, the number of intensities of the secondary fragment ion over time sufficient to quantify the compound of interest includes a number sufficient to provide a reliable peak shape for the secondary fragment ion.

In various embodiments, if separation device 310 performs liquid chromatography (LC), for example, the number of intensities of the secondary fragment ion over time sufficient to quantify the compound of interest includes a number sufficient to provide a reliable survey of intensities of the secondary fragment ion across an LC peak of the compound of interest.

In various embodiments, sMRM experiments can be halted as soon as the one or more $MS^3$ experiments are triggered. For example, processor 330 can instruct mass spectrometer 320 to stop the sMRM experiments, when an intensity for the product ion of an sMRM experiment of the plurality of sMRM experiments first reaches a level that is equal to or greater than the threshold intensity level.

In various alternative embodiments, sMRM experiments continue even after the one or more $MS^3$ experiments are triggered. If sMRM experiments continue even after the one or more $MS^3$ experiments are triggered, processor 330 can prevent another group of one or more $MS^3$ experiments being triggered for the time period of separation. For example, processor 330 instructs mass spectrometer 320 to perform one or more $MS^3$ experiments for the product ion only when a first intensity for the product ion of an sMRM experiment of the plurality of sMRM experiments is equal to or exceeds the threshold intensity level.

In various embodiments, if sMRM experiments continue even after the one or more $MS^3$ experiments are triggered, processor 330 can stop the triggered one or more $MS^3$ experiments by determining if an intensity produced by the sMRM experiments falls below the threshold intensity level. For example, after processor 330 instructs mass spectrometer 320 to perform one or more $MS^3$ experiments for the product ion, processor 330 can instruct mass spectrometer 320 to stop $MS^3$ experiments for the product ion, when an intensity for the product ion of an sMRM experiment of the plurality of sMRM experiments is less than the threshold intensity level.

Method for Scheduled $MS^3$

Figure 4:
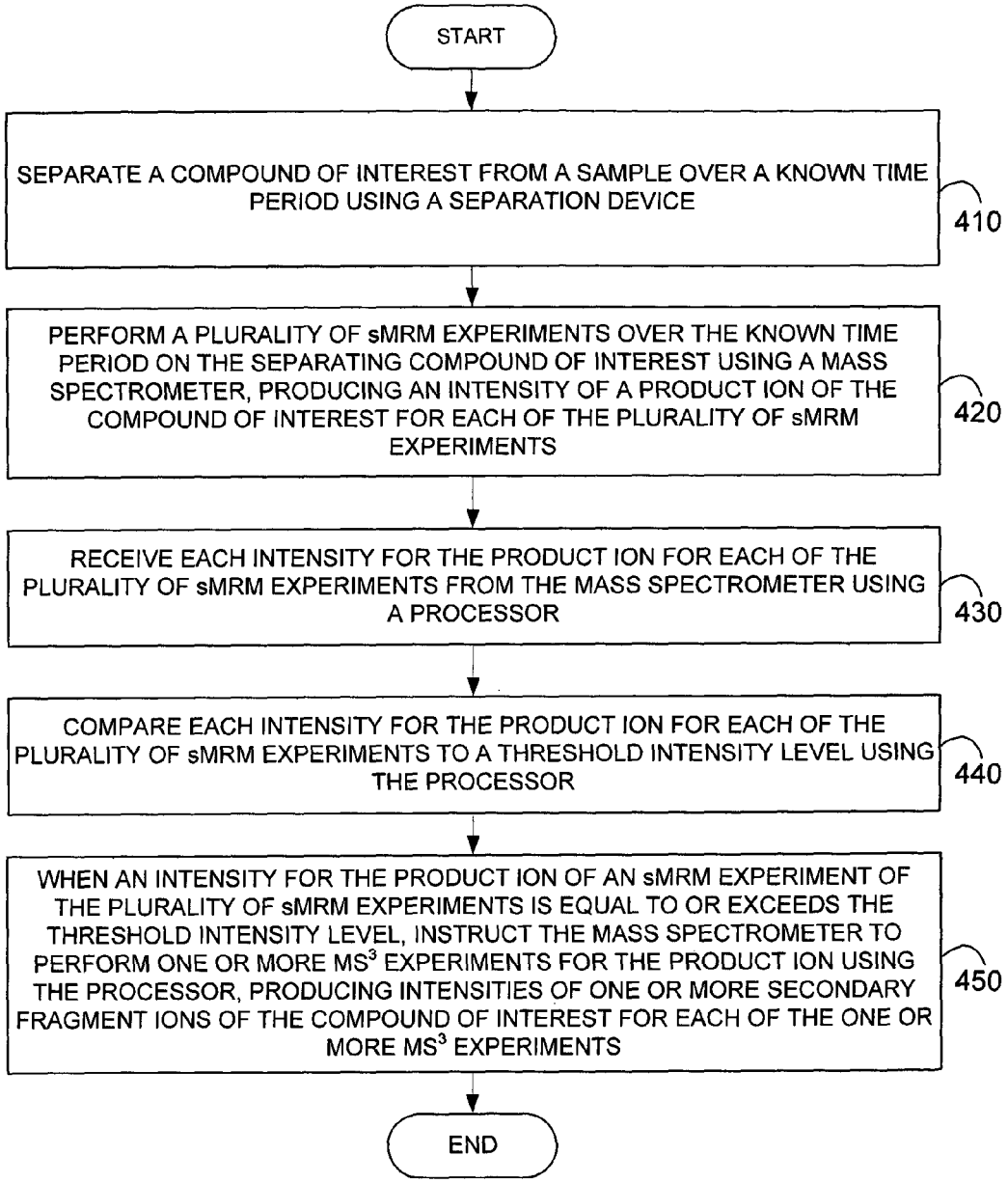
FIG. 4 is an exemplary flowchart showing a method for scheduled $MS^3$, in accordance with various embodiments.

FIG. 4 is an exemplary flowchart showing a method 400 for scheduled $MS^3$, in accordance with various embodiments.

In step 410 of method 400, a compound of interest is separated from a sample over a known time period using a separation device.

In step 420, a plurality of scheduled multiple reaction monitoring (sMRM) experiments are performed over the known time period on the separating compound of interest using a mass spectrometer. An intensity of a product ion of the compound of interest is produced for each of the plurality of sMRM experiments.

In step 430, each intensity for the product ion for each of the plurality of sMRM experiments is received from the mass spectrometer using a processor.

In step 440, each intensity for the product ion for each of the plurality of sMRM experiments is compared to a threshold intensity level using the processor.

In step 450, when an intensity for the product ion of an sMRM experiment of the plurality of sMRM experiments is equal to or exceeds the threshold intensity level, the mass spectrometer is instructed to perform one or more $MS^3$ experiments for the product ion using the processor. Intensities of one or more secondary fragment ions of the compound of interest are produced for each of the one or more $MS^3$ experiments.

Computer Program Product for Scheduled $MS^3$

In various embodiments, computer program products include a tangible computer-readable storage medium whose contents include a program with instructions being executed on a processor so as to perform a method for scheduled $MS^3$. This method is performed by a system that includes one or more distinct software modules.

Figure 5:
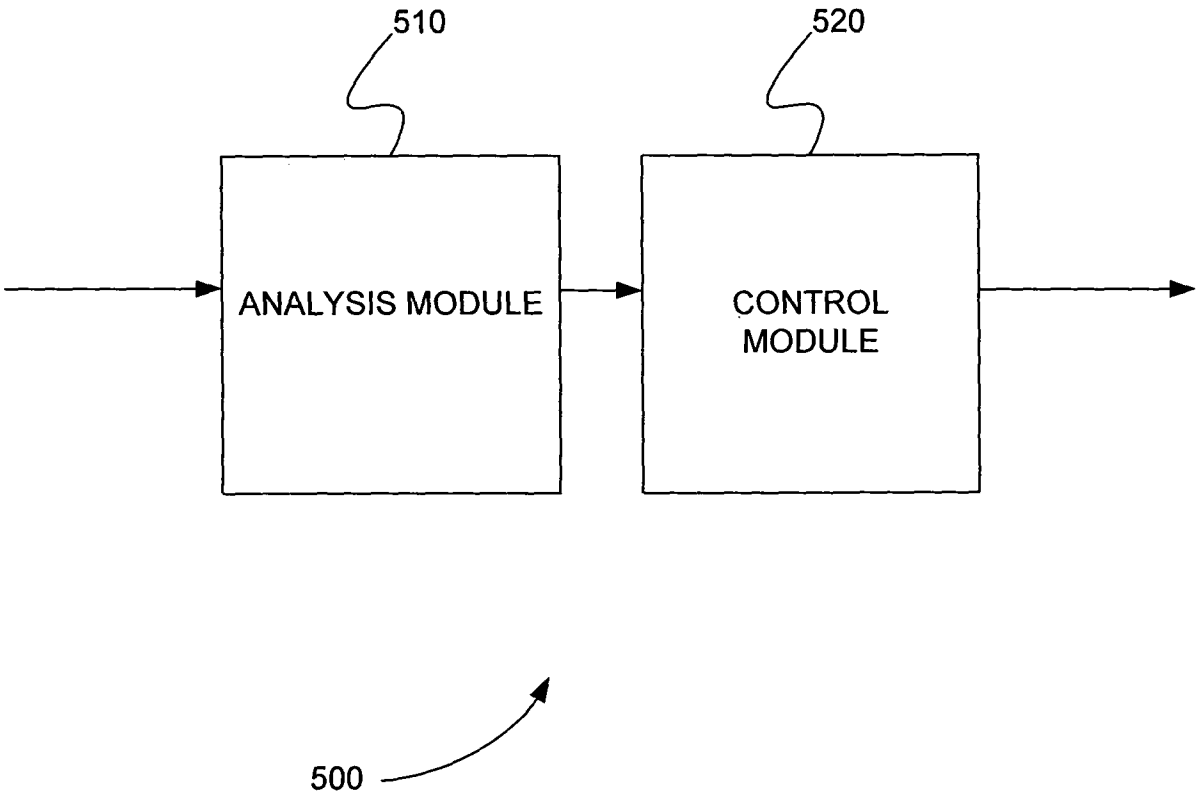
FIG. 5 is a schematic diagram of a system that includes one or more distinct software modules that performs a method for scheduled $MS^3$, in accordance with various embodiments.

FIG. 5 is a schematic diagram of a system 500 that includes one or more distinct software modules that performs a method for scheduled $MS^3$, in accordance with various embodiments. System 500 includes analysis module 510 and control module 520.

Analysis module 510 receives an intensity for a product ion for each of a plurality of scheduled multiple reaction monitoring (sMRM) experiments from a mass spectrometer. Each intensity for the product ion of each of the plurality of sMRM experiments is produced by performing the plurality of sMRM experiments over a known time period on a separating compound of interest using a mass spectrometer. The separating compound of interest is separated from a sample over the known time period using a separation device.

Analysis module 510 compares each intensity for the product ion for each of the plurality of sMRM experiments to a threshold intensity level. When an intensity for the product ion of an sMRM experiment of the plurality of sMRM experiments is equal to or exceeds the threshold intensity level, control module 520 instructs the mass spectrometer to perform one or more $MS^3$ experiments for the product ion using the processor. Intensities of one or more secondary fragment ions of the compound of interest are produced for each of the one or more $MS^3$ experiments.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for scheduled mass spectrometry/mass spectrometry/mass spectrometry ($MS^3$), comprising:

a separation device that separates a compound of interest from a sample over a known time period;

a mass spectrometer that performs a plurality of scheduled multiple reaction monitoring (sMRM) experiments over the known time period on the separating compound of interest, producing an intensity of a product ion of the compound of interest for each of the plurality of sMRM experiments; and a processor in communication with the mass spectrometer and the separation device that is configured to receive each intensity for the product ion for each of the plurality of sMRM experiments from the mass spectrometer, compare each intensity for the product ion for each of the plurality of sMRM experiments to a threshold intensity level, and when an intensity for the product ion of an sMRM experiment of the plurality of sMRM experiments is equal to or exceeds the threshold intensity level, instruct the mass spectrometer to perform one or more $MS^3$ experiments for the product ion, producing intensities of one or more secondary fragment ions of the compound of interest for each of the one or more $MS^3$ experiments, wherein each sMRM experiment of the plurality of sMRM experiments is scheduled during a predicted or known elution time of the separating compound of interest, and wherein the one or more $MS^3$ experiments comprise a cycle of $MS^3$ experiments that provide a number of intensities of the secondary fragment ions over time to quantify the compound of interest in the sample.

2. The system of claim 1, wherein the processor is further configured to identify the compound of interest from an intensity of the secondary fragment ion produced by the one or more $MS^3$ experiments.

3. The system of claim 1, wherein the number of intensities of the secondary fragment ions over time to quantify the compound of interest in the sample comprises a number to provide a representative of a liquid chromatography (LC) peak shape for the secondary fragment ion.

4. The system of claim 1, wherein the processor is configured to instruct the mass spectrometer to stop the sMRM experiments when an intensity for the product ion of an sMRM experiment of the plurality of sMRM experiments first reaches a level that is equal to or greater than the threshold intensity level, thereby halting the plurality of sMRM experiments as soon as the one or more $MS^3$ experiments are triggered.

5. The system of claim 1, wherein the processor is configured to instruct the mass spectrometer to perform one or more $MS^3$ experiments for the product ion only when a first intensity for the product ion of an sMRM experiment of the plurality of sMRM experiments is equal to or exceeds the threshold intensity level to prevent another group of one or more $MS^3$ experiments being triggered for a time period of separation.

6. The system of claim 1, wherein the processor is further configured to determine, after instructing the mass spectrometer to perform one or more $MS^3$ experiments for the product ion, when an intensity for the product ion of an sMRM experiment of the plurality of sMRM experiments is less than the threshold intensity level, instructs the mass spectrometer to stop $MS^3$ experiments for the product ion.

7. A method for scheduled mass spectrometry/mass spectrometry/mass spectrometry ($MS^3$), comprising:

separating a compound of interest from a sample over a known time period using a separation device;

performing a plurality of scheduled multiple reaction monitoring (sMRM) experiments over the known time period on the separating compound of interest using a mass spectrometer, producing an intensity of a product ion of the compound of interest for each of the plurality of sMRM experiments, wherein each sMRM experiment of the plurality of sMRM experiments is scheduled during a predicted or known elution time of the separating compound of interest;

receiving each intensity for the product ion for each of the plurality of sMRM experiments from the mass spectrometer using a processor;

comparing each intensity for the product ion for each of the plurality of sMRM experiments to a threshold intensity level using the processor, and when an intensity for the product ion of an sMRM experiment of the plurality of sMRM experiments is equal to or exceeds the threshold intensity level, instructing the mass spectrometer to perform one or more $MS^3$ experiments for the product ion using the processor, producing intensities of one or more secondary fragment ions of the compound of interest for each of the one or more $MS^3$ experiments, wherein the one or more $MS^3$ experiments comprise a cycle of $MS^3$ experiments that provide a number of intensities of the secondary fragment ions over time to quantify the compound of interest in the sample.

8. The method of claim 7, further comprising identifying the compound of interest from an intensity of the secondary fragment ion produced by the one or more $MS^3$ experiments using the processor.

9. The method of claim 7, wherein the number of intensities of the secondary fragment ions over time to quantify the compound of interest in the sample comprises a number to provide a representative of a liquid chromatography (LC) peak shape for the secondary fragment ion.

10. The method of claim 7, further comprising instructing the mass spectrometer to stop the sMRM experiments when an intensity for the product ion of an sMRM experiment of the plurality of sMRM experiments first reaches a level that is equal to or greater than the threshold intensity level, thereby halting the plurality of sMRM experiments as soon as the one or more $MS^3$ experiments are triggered.

11. The method of claim 7, further comprising instructing the mass spectrometer to perform one or more $MS^3$ experiments for the product ion only when a first intensity for the product ion of an sMRM experiment of the plurality of sMRM experiments is equal to or exceeds the threshold intensity level using the processor, to prevent another group of one or more $MS^3$ experiments being triggered for a time period of separation.

12. The method of claim 7, further comprising after instructing the mass spectrometer to perform one or more $MS^3$ experiments for the product ion, determining when an intensity for the product ion of an sMRM experiment of the plurality of sMRM experiments is less than the threshold intensity level using the processor and instructing the mass spectrometer to stop $MS^3$ experiments for the product ion when an intensity for the product ion of an sMRM experiment of the plurality of sMRM experiments is less than the threshold intensity level using the processor.

13. A computer program product, comprising a non-transitory and tangible computer-readable storage medium whose contents include a program with instructions being executed on a processor so as to perform a method for scheduled mass spectrometry/mass spectrometry/mass spectrometry ($MS^3$), the method comprising:

providing a system, wherein the system comprises one or more distinct software modules, and wherein the distinct software modules comprise an analysis module and a control module;

receiving an intensity for a product ion for each of a plurality of scheduled multiple reaction monitoring (sMRM) experiments the plurality of sMRM experiments from a mass spectrometer using the analysis module, wherein each intensity for the product ion of each of the plurality of sMRM experiments is produced by performing the plurality of sMRM experiments over a known time period on a separating compound of interest using a mass spectrometer, and wherein the separating compound of interest is separated from a sample over the known time period using a separation device;

performing a plurality of scheduled multiple reaction monitoring (sMRM) experiments, producing an intensity of a product ion of the compound of interest for each of the plurality of sMRM experiments, wherein each sMRM experiment of the plurality of sMRM experiments is scheduled during a predicted or known elution time of the separating compound of interest;

comparing each intensity for the product ion for each of the plurality of sMRM experiments to a threshold intensity level using the control module; and when an intensity for the product ion of an sMRM experiment of the plurality of sMRM experiments is equal to or exceeds the threshold intensity level, instructing the mass spectrometer to perform one or more $MS^3$ experiments for the product ion using the control module, producing intensities of one or more secondary fragment ions of the compound of interest for each of the one or more $MS^3$ experiments, wherein the one or more $MS^3$ experiments comprise a cycle of $MS^3$ experiments that provide a number of intensities of the secondary fragment ions over time to quantify the compound of interest in the sample.

14. The computer program product of claim 13, wherein the method further comprises identifying the compound of interest from an intensity of the secondary fragment ion produced by the one or more $MS^3$ experiments using the analysis module.

15. The computer program product of claim 13, wherein the number of intensities of the secondary fragment ions over time to quantify the compound of interest in the sample comprises a number to provide a representative of a liquid chromatography (LC) peak shape for the secondary fragment ion.

16. The computer program product of claim 13, wherein the method further comprises instructing the mass spectrometer to stop the sMRM experiments when an intensity for the product ion of an sMRM experiment of the plurality of sMRM experiments first reaches a level that is equal to or greater than the threshold intensity level, thereby halting the plurality of sMRM experiments as soon as the one or more $MS^3$ experiments are triggered.

17. The computer program product of claim 13, wherein method further comprises instructing the mass spectrometer to perform one or more $MS^3$ experiments for the product ion only when a first intensity for the product ion of an sMRM experiment of the plurality of sMRM experiments is equal to or exceeds the threshold intensity level using the control module, to prevent another group of one or more $MS^3$ experiments being triggered for a time period of separation.

* * * * *